US007467750B2

(12) United States Patent
Feinleib

(10) Patent No.: US 7,467,750 B2
(45) Date of Patent: Dec. 23, 2008

(54) NEEDLE-SPRING LOCKING DEVICE FOR PUMP-INJECTOR (INJECTOR) FOR INTERNAL COMBUSTION ENGINES

(75) Inventor: Boris Feinleib, Jerusalem (IL)

(73) Assignee: Mazrek Ltd., Jerusalem (IL)

( * ) Notice: Subject to any disclaimer, the term of this patent is extended or adjusted under 35 U.S.C. 154(b) by 62 days.

(21) Appl. No.: 11/658,036

(22) PCT Filed: Jul. 20, 2004

(86) PCT No.: PCT/IL2004/000658

§ 371 (c)(1),
(2), (4) Date: Jan. 22, 2007

(87) PCT Pub. No.: WO2006/008728

PCT Pub. Date: Jan. 26, 2006

(65) Prior Publication Data

US 2007/0235008 A1 Oct. 11, 2007

(51) Int. Cl.
*F02M 47/02* (2006.01)

(52) U.S. Cl. ..... 239/88

(58) Field of Classification Search ..... 239/88–96
See application file for complete search history.

(56) References Cited

U.S. PATENT DOCUMENTS 3,403,632 A * 10/1968 Hulsing ..... 417/458
3,761,023 A * 9/1973 Gueret et al. ..... 239/585.4
5,328,094 A * 7/1994 Goetzke et al. ..... 239/88
RE35,079 E * 11/1995 Sverdlin ..... 123/467
6,202,940 B1 * 3/2001 Kampichler ..... 239/88
6,557,779 B2 * 5/2003 Perr et al. ..... 239/96
6,752,334 B2 * 6/2004 Augustin ..... 239/585.5
7,036,465 B2 * 5/2006 Burk et al. ..... 123/21
7,055,762 B2 * 6/2006 Gerber et al. ..... 239/73
7,225,790 B2 * 6/2007 Bartunek et al. ..... 123/294
2005/0269422 A1 * 12/2005 Gerber et al. ..... 239/102.2
2007/0217926 A1 * 9/2007 Tansug ..... 417/289

* cited by examiner

*Primary Examiner*—Thomas N Moulis
(74) *Attorney, Agent, or Firm*—Nath Law Group; Jerald L. Meyer; Derek Richmond

(57) ABSTRACT

Needle-spring locking device for pump-injectors (injectors) of diesels, in which in order to significantly increase the lift and closing pressures of the nozzle needle, the locking spring (17) is disposed in the central cavity of the body around the outer surface of the plunger's bushing (2) and is connected with the needle (14) via a transversal cross-arm (15) disposed in the plunger bushing (2). This allows for increasing the average diameter of the needle spring (17) from 1.2-1.4 cm to 2-2.5 cm, and the spring power from 35-50 kgf to 180-220 kgf, respectively. In this case, the lift pressure of the nozzle body (10) (when the needle diameter is 0.6 cm) can amount to about 1200 kgf/cm$^2$, and the closing pressure of the nozzle body (10) can amount to about 800 kgf/cm$^2$, which corresponds to maximum injection pressures of 2000-2500 kgf/cm, as required for ensuring greater fuel efficiency and lower exhaust smoke and particle matter emission in future diesels.

3 Claims, 1 Drawing Sheet

Figure 1:
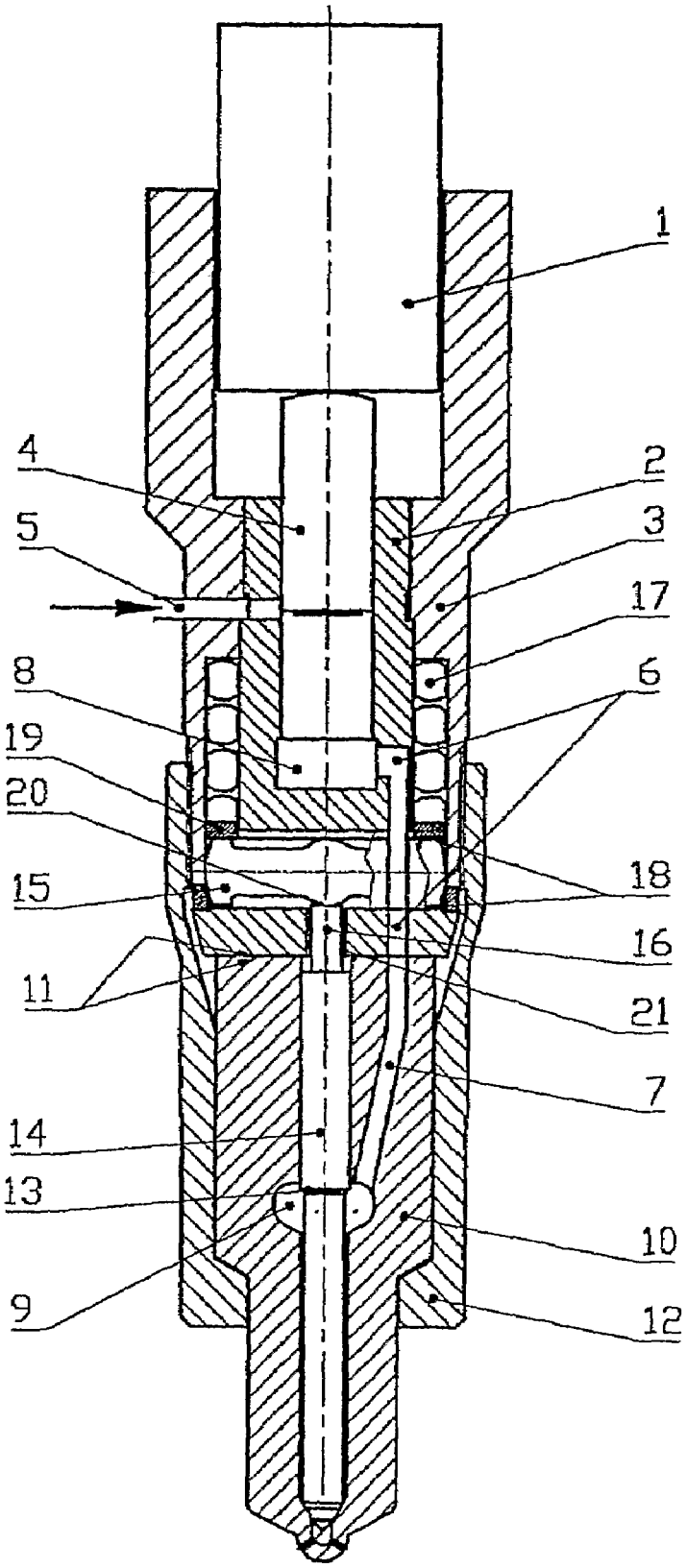

NEEDLE-SPRING LOCKING DEVICE FOR PUMP-INJECTOR (INJECTOR) FOR INTERNAL COMBUSTION ENGINES

TECHNICAL FIELD

Needle-spring locking device in accordance with the invention relates to-pump-injectors and to conventional injectors of fuel supply systems for internal combustion engines, specifically for diesels.

BACKGROUND ART

In order to ensure greater fuel efficiency and lower exhaust smoke and particulate matter (PM) emission, the maximum and medium injection pressures in modern diesels are constantly increased. By now, commonly used injection pressures have reached 1600-2000 Bar, and in the near future they will reach 2500 Bar and more. The increase of the maximum and medium injection pressures is facilitated by the increase in the nozzle needle lift and closing pressures (pressures causing the needle to start its travel upward and reverse, to travel downward and seat on the nozzle's cone). The latter is also especially important for lowering exhaust smoke emission, in particular (PM), because by increasing the force on the nozzles needle, the needle closes faster, resulting sharp EOI (nd Of Injection), thus reducing the quantity of the fuel injected into the combustion chamber under low pressure at the final phase of the injection.

In modern diesels, needle-spring locking devices are most frequently used, with a cylindrical helical spring usually disposed in a central cavity formed in the pump-injector) body. The diameter of such cavities in actual diesels does not exceed 12-14 mm, because larger diameters would not allow for disposing and sealing the joint surfaces between the high-pressure channel delivering the fuel from under-plunger cavity, and the high-pressure channel of the nozzle body.

According to a common formula, the maximum force that can be created by a cylindrical helical spring equals $F_{max}=\tau\pi d^3/8D$(Kgf), where $\tau$—is maximum allowed torsion stress, d—diameter of the spring wire, D—average diameter of the spring coil. If we assume that for a cyclically working spring $\tau$=3,000 kg/cm$^2$, and minimum permissible ratio D/d=3 (based on the manufacturing considerations), the formula above can be reduced to: $F_{max}=44D^2$ kgf.

Considering the dimensions of the cavity where the spring is disposed (see above) and granted that D/d=3, the permissible values for the average spring diameter will be D=0.9-1.05 cm. According to the formula above, the maximum spring force in the state-f-the-art diesels is $F_{max}$=36+48 kgf. In modem high-speed diesels, the diameter of the nozzle needle is usually 0.6 cm and the needle cross-section differential coefficient is 0.65 (the ratio of the difference between the area of the needle cross-section and the area bounded by the circumference of the bearing edge of the needle cone to the needle cross-section area). In this case (granted that $F_{max}$=50 kgf), the fuel pressure during the needle's travel upward will be about 400 kgf/cm$^2$, and the fuel pressure in the beginning of the closing of the needle will be 280 kgf/cm$^2$, which is not enough, considering the maximum injection pressures specified above (2000-2500 Bar and higher).

DISCLOSURE OF THE INVENTION

In order to significantly increase the lift and closing pressures of the proposed nozzle needle, the needle locking spring is disposed in the central cavity of the body around the outer surface of the plunger bushing and is connected to the needle via a transverse cross-arm disposed in the plunger bushing. In this case, the average diameter of the needle spring can reach 2-2.2 cm, and the spring force according to the above formula will constitute about 180-220 kgf. The nozzle lift pressure will then be about 1200 kgf/cm$^2$ (if the needle diameter is 0.6 cm), and the nozzle closing pressure will be about 650-800 kgf/cm$^2$, which better suits said maximum injection pressures (2000 kgf/cm$^2$ and higher).

It should be noted that high lift and closing pressures of the nozzle (900 and 600 kgf/cm$^2$ respectively) could be achieved in the proposed device even if the needle diameter is increased to 0.8 cm (corresponding to the cavity diameter of 2.5 cm) as is common in high-power diesels.

Needle-spring locking device in accordance with the invention is implemented in the design environment comprising a pumping plunger moving inside a bushing driven by a cam or hydro mechanical piston mechanism. The plunger bushing has an upper cylindrical part in which the plunger is moving and a lower larger diameter part with a precision face adjacent to the precision face of the nozzle, the pump-injector body being pressed to the nozzle body along said surfaces by a tightening nut. The subject of the invention also consists of the said lower part of the bushing that. has an aperture located above the precision face perpendicularly to the bushing axis (or centerline), and an axial opening adjoining the centre of said aperture to which the face of the nozzle needle is exposed. As mentioned above, a helical spring is mounted around the outer surface of the upper part of the plunger's bushing, one face of said spring pressed against said body, and its second face pressed against the edge surfaces of the cross-arm installed in said aperture of the lower part of the bushing. The central part of the cross-arm is pressed against the face of the nozzle needle. Said cross-arm and the spring interact via a washer installed between said cross-arm and the bearing face of the spring. The cross-arm has a spherical form at the contact areas with said washer and the face of the nozzle needle.

SUMMARY OF THE INVENTION

To illustrate the proposed device, FIG. 1 shows a functional diagram of a pumping unit of a hydraulically driven pump-injector with proposed needle-spring locking device.

In FIG. 1:1—driving mechanism of the plunger; 2—plunger's bushing; 3—pump-injector body; 4—plunger; 5—filling channel; 6—high-pressure channel in the plunger bushing 2; 7—channel in the nozzle body; 8—underplunger cavity; 9—high-pressure chamber in the nozzle body; 10—nozzle body; 11—precision surface joints between pump-injector body and nozzle body; 12—tightening nut; 13—differential cross section of the needle; 14—nozzle needle; 15—transverse cross-arm; 16—pin of the nozzle needle;17—return spring of the nozzle needle; 18—edge sections of cross-arm 15; 19—spring washer; 20—central section of cross-arm 15; 21—radial channel in the plunger bushing.

The pump-injector operates as follows:

Driving mechanism 1 forcing plunger 4 installed in bushing 2, and plunger 4 blocking filling channel 5 in body 3, the fuel in cavity 8 is exposed via channel 6 in bushing 2 and channel 7 in the nozzle body into chamber 9 of nozzle body

10. The sealing of channels 6 and 7 is achieved by surface precision joint 11 between pump-injector and nozzle bodies, pressed together by nut 12. Due to the action of the fuel on differential cross section 13 of nozzle needle 14, needle 14 that presses with its pin 16 on transverse cross-arm 15 disposed in cylindrical aperture of the bushing, travels upward overcoming the force of spring 17, arranged around the outer surface of said plunger bushing, whose lower face is set against the outer edges 18 of said cross-arm 15. At the end of the needle working stroke when the pressure in chamber 9 falls, the needle due to the action of spring 17 acting on the needle through cross-arm 15, seats on the cone of the nozzle body. To achieve high contact force between the cross arm 15 and the nozzle needle, while eliminating lateral forces to act on the needle, washer 19 is used. The edges of cross-arm 15 and central section 20, contacting pin 16 of needle 14, have a spherical surface. As has already been mentioned, transverse cross-arm 15 is disposed in the aperture of bushing 2, said aperture being perpendicular to the bushing axis, and radial channel 21 being made in the bushing for pin 16 of needle 14, contacting said cross-arm, said channel being connected with the center of said cylindrical channel. Driving mechanism 1 of plunger 4 can be made as a cam or hydraulically driven piston.

It will be evident to those skilled in the art that the invention is not limited to the details of the foregoing illustrated embodiments and that the present invention may be embodied in other specific forms -without departing from the spirit or essential attributes thereof The present embodiments are therefore to be considered in all respect as illustrative and not restrictive, the scope of the invention being indicated by the appended claims rather than by the foregoing description, and all changes which come within the meaning and range of equivalency of the claims are therefore intended to be embraced therein.

BEST MODE FOR CARRYING OUT THE INVENTION

In the above embodiment shown in FIG. 1, the needle is pressed against the cross-arm with its pin 16. This allows for using conventional nozzles in the proposed spring-locking device without any modifications. However, it is also possible to use a needle without a pin in the proposed device. In this case, the needle can have a flat face, pressed against central section 20 of cross-arm 15, and said central section of the cross-arm being pressed against the body of plunger's bushing 2. In the first case, the stroke of the needle is determined by stopping its face against the precision surface of the body, and in the second case—by stopping the central section of the cross-arm against the pump-injector's body. The locking device in accordance with the invention can be realized both in the case when the plunger is moving inside the bushing installed in pump-injector body and also in the case when the plunger is moving directly in the pump-injector body, having a precision joint with the latter. In the latter case, the cylindrical channel for the cross-arm, as well as the radial channel for the tail section of the nozzle needle is made directly in the pump-injector body.

INDUSTRIAL APPLICABILITY

The spring locking device of the nozzle needle according to the invention, as mentioned above, can be used in diesel pump-injectors, by both methods, either the plunger being driven by a cam, or the plunger being forced by a hydraulically driven piston. This device is especially efficient in a pump-injector for high-power diesels where high injection pressures of 2000 Bar and higher are used (for reasons mentioned above). The proposed locking device can also be used in conventional injectors of said diesels.

I claim:

1. Needle-spring locking device for pump-injectors (injectors) of fuel supply systems for internal combustion engines, specifically for diesels, which is mounted in the body of pump-injector (injector), wherein a bushing with pumping plunger is installed, driven by a cam or by hydraulically driven piston, said plunger's bushing having an upper cylindrical part, in which the plunger is moving, and a lower, larger-diameter part with a precision surface adjoining the precision surface of the body of nozzle, consisting also the nozzle needle and it's spring, a pump-injector body and nozzle body being pressed together by a tightening nut along said surfaces, said device distinguished by the fact that a cylindrical helical spring is mounted around the outer surface of the upper part of the plunger's bushing and a cylindrical aperture being formed in the lower, larger-diameter part of the bushing above the precision face, said aperture being perpendicular to the bushing axle, and a radial opening also formed in the bushing adjoining the center of said aperture; a cross-arm being mounted in said cylindrical aperture, and the face of the nozzle needle coming out to said radial opening;, one face of the spring stopping against said body, and the other face stopping upon ends of said cross-arm, its central section stopped against the face of the nozzle needle.

2. Needle-spring locking device as in claim 1, wherein said cross-arm and spring interact through a disc installed between the cross-arm and the bearing face of the spring.

3. Needle-spring locking device as in claim 2, wherein the surfaces of said cross-arm in the contact areas with said disc and face of the nozzle needle are spherical.

* * * * *